US006827079B2

(12) United States Patent
Ahmady

(10) Patent No.: US 6,827,079 B2
(45) Date of Patent: Dec. 7, 2004

(54) APPARATUS AND METHOD FOR REDUCING PEAK TEMPERATURE HOT SPOTS ON A GAS FIRED INFRARED INDUSTRIAL HEATER

(75) Inventor: Farshid Ahmady, Rochester Hills, MI (US)

(73) Assignee: Solaronics, Inc., Rochester, MI (US)

( * ) Notice: Subject to any disclaimer, the term of this patent is extended or adjusted under 35 U.S.C. 154(b) by 156 days.

(21) Appl. No.: 10/083,443

(22) Filed: Feb. 26, 2002

(65) Prior Publication Data

US 2003/0159691 A1 Aug. 28, 2003

(51) Int. Cl.[7] ..... F24C 3/04
(52) U.S. Cl. ..... 126/91 A; 126/92 B
(58) Field of Search ..... 126/91 R, 91 A, 126/85 R, 92 R, 92 B, 85 A; 431/326, 328

(56) References Cited

U.S. PATENT DOCUMENTS 3,805,763 A * 4/1974 Cowan ..... 126/92 R
4,390,125 A * 6/1983 Rozzi ..... 126/92 B
4,634,373 A * 1/1987 Rattner ..... 431/328
4,716,883 A * 1/1988 Johnson ..... 126/85 R
4,727,854 A * 3/1988 Johnson ..... 126/92 B
5,052,921 A * 10/1991 Hemsath ..... 431/7
6,286,500 B1 * 9/2001 Jones ..... 126/91 A

FOREIGN PATENT DOCUMENTS

DE 36 30 098 A1 * 3/1988 ..... F24D/5/04
WO WO 95/32399 * 11/1995 ..... F24D/5/08

OTHER PUBLICATIONS

Ahmady, Farshid, "Solaronics: Gas–Fired IR Burners are Worth Considering," Process Heating publication, Jul./Aug. 1994.
"Honing a Specialty," Appliance publication, Jun. 1992.
"Solaronics Gas Infra–Red Burners for Commercial, Industrial and Residential Appliances" company brochure.
"Solaronics Infra–Red Heaters" product brochure, 15620/SOL.

* cited by examiner

*Primary Examiner*—Josiah Cocks
(74) *Attorney, Agent, or Firm*—Young & Basile, P.C.

(57) ABSTRACT

A radiant heating system including at least one gas burner and at least one conduit connected to the at least one burner on one end and connected to at least one exhaust tube at an opposite end for transporting hot exhaust gas. Heat is transferred via conduction to an external surface of the conduit. The heat is then radiated omnidirectionaly from the external surface of the conduit as infrared rays. A fan directs a stream of air across the external surface of the conduit to cool the conduit allowing the at least one burner to operate continuously for longer periods of time.

14 Claims, 3 Drawing Sheets

APPARATUS AND METHOD FOR REDUCING PEAK TEMPERATURE HOT SPOTS ON A GAS FIRED INFRARED INDUSTRIAL HEATER

FIELD OF THE INVENTION

This invention relates to an apparatus and method for cooling hot areas of infrared conduits in a gas fired infrared radiant heater.

BACKGROUND OF THE INVENTION

Gas fired infrared heaters typically are used in large industrial settings. A gas heater burns natural gas, propane, or similar combustible gases and the combustion by-products or exhaust gasses pass through a heat exchanger conduit to heat a building. The gas heater creates a hot exhaust gas stream flowing through heat exchanger conduits, causing the conduits to become hot and radiate energy waves therefrom. Reflector plates are often used to reflect the energy waves toward the desired location, usually toward the floor, where the infrared energy waves are converted into heat.

In some environments it is desirable that no surface temperature exceed predefined limits. Often in certain environments, federal or state restrictions limit the maximum surface temperature on any surface within an enclosed area.

Prior art infrared heaters cannot be used in these of environments because the temperatures on their surfaces exceed these limits. Therefore, often no heat is provided in these environments for this reason.

SUMMARY OF THE INVENTION

The present invention limits the peak temperature on the external surface of a conduit associated with infrared gas burners by cooling the conduit and/or shutting off the burner if necessary. At least one thermocouple, or other temperature measuring device, is installed at a predetermined point on the conduit corresponding to the peak temperature location for signaling a control valve to shut off the burner when the peak temperature on the external surface of the conduit approaches a predefined limit.

An improvement to the infrared heater system provides for a forced air convective cooling system, such as a fan or blower, with proper velocity vectoring via a deflector or other flow directing device to cool a conduit hot spot. The cooling system can be designed as a part of a control system to operate the blower. The convective cooling allows the burner to run continuously for a longer period of time and, therefore, more efficiently with a more uniform temperature gradient throughout the tubing system. This mode of operation produces more usable heat for a given amount of fuel consumed.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings, wherein like reference numerals refer to like parts throughout the several views, and wherein.

DESCRIPTION OF THE PREFERRED EMBODIMENT

Figure 1:
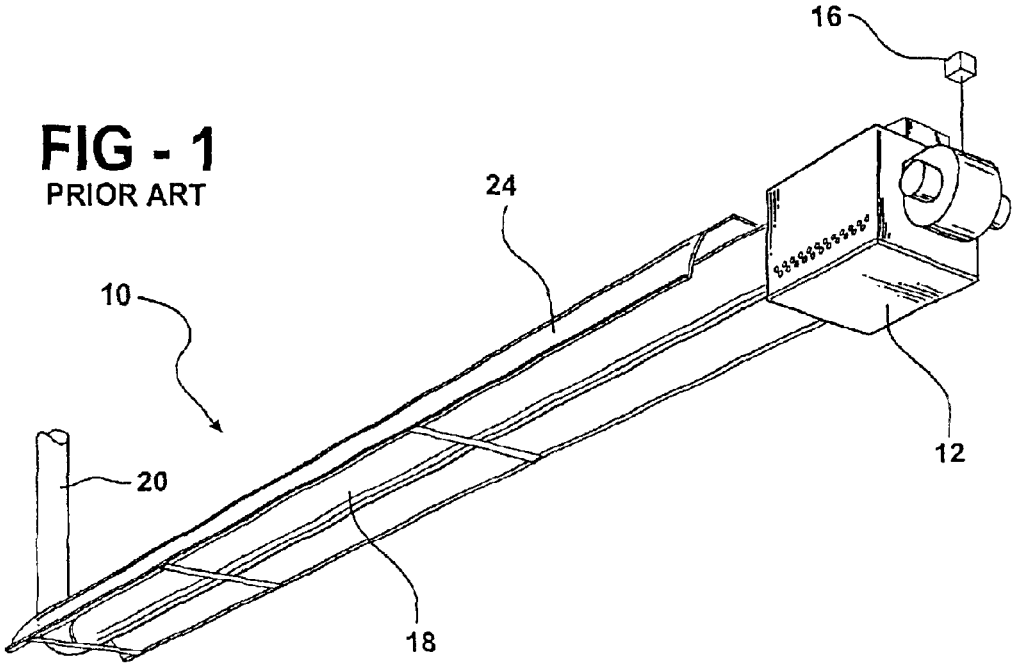
FIG - 1 PRIOR ART
FIG. 1 is a simplified schematic view of a prior art infrared burner attached to a large conduit system for heating industrial buildings.
Figure 2:
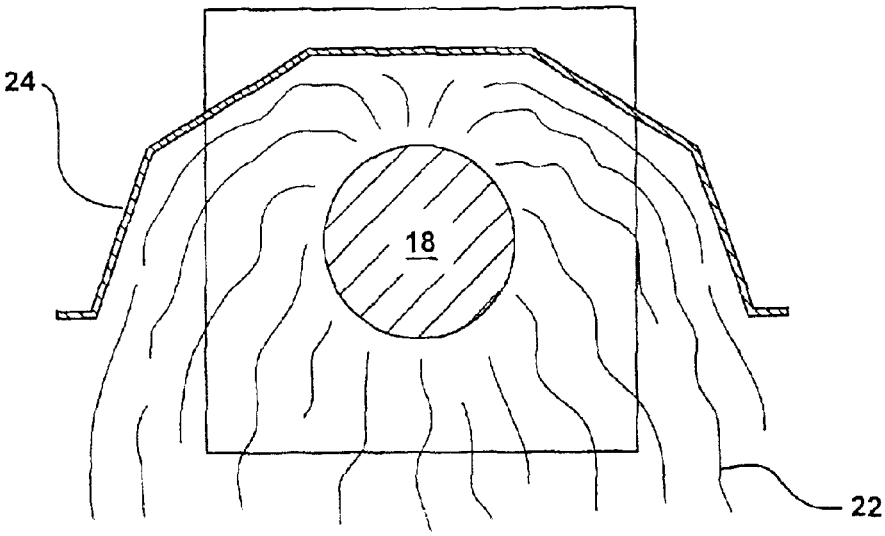
FIG - 2 PRIOR ART
FIG. 2 is a cross-sectional view of a prior art conduit radiating heat to a reflector to be reflected and radiated back down towards the floor.

FIG. 1 illustrates a radiant heating system 10 having a gas burner 12 operable in response to a thermostat 16. Conduit 18 is connected to the gas burner 12 on one end and to an exhaust manifold 20 at the other end. The burner emits a flame 17 (shown in dash lines) into a conduit 18. The conduit 18 transfers heat created by flame 17 via conduction to an external surface where the heat is radiated omnidirectionaly as infrared rays 22 as shown in FIG. 2. The flame creates a heat gradient along the length of conduit 18 with one location being the hottest. A reflector 24 is operably associated with the conduit 18 for reflecting the infrared rays in a desired direction as best seen in FIG. 2.

Figure 3A:
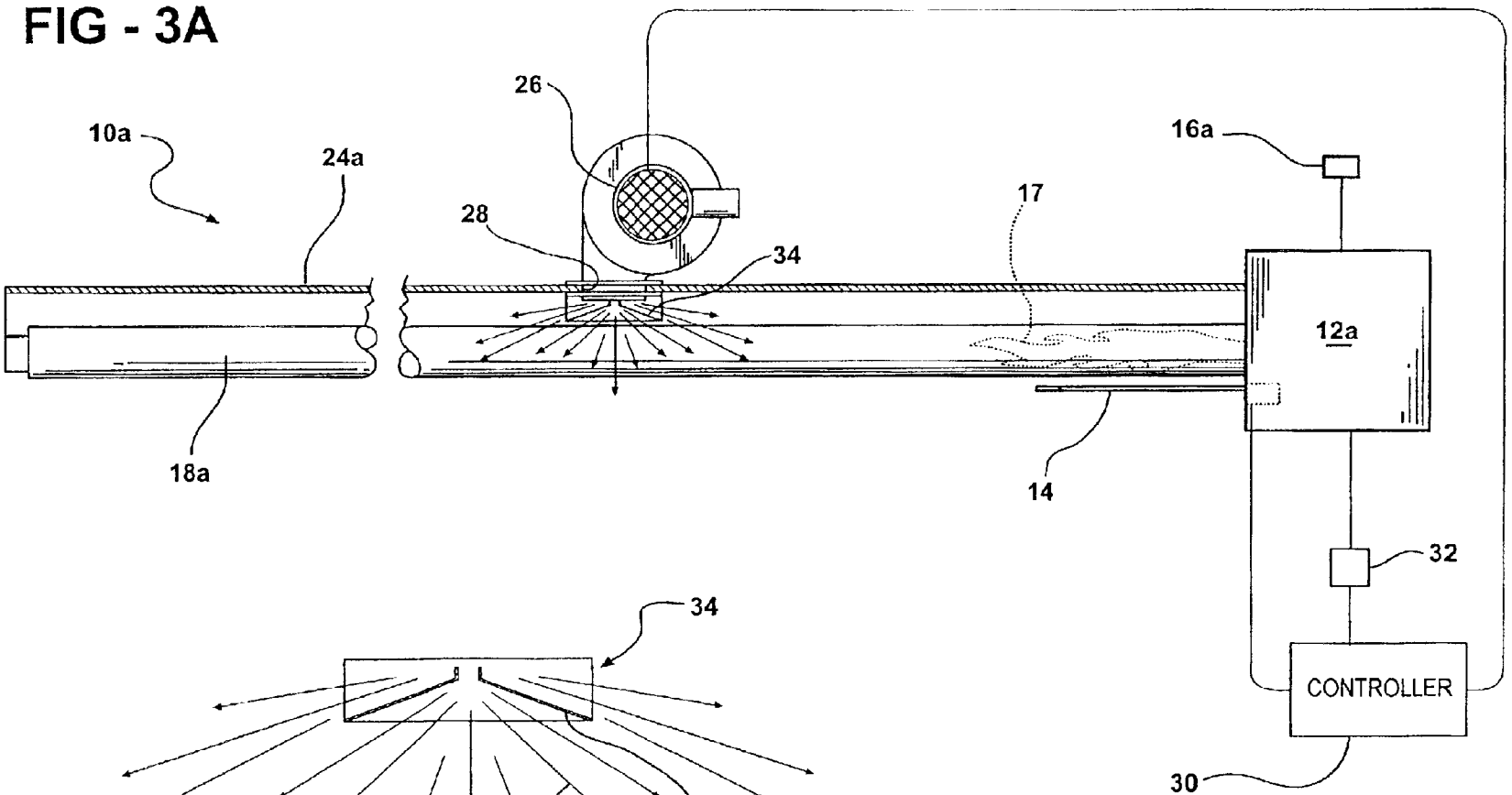
FIG. 3A is a perspective view of a blower system including a fan, deflector, and an infrared conduit.

Referring now to FIG. 3A, a fan 26 convectively cools conduit 18*a* The fan 26 is positioned generally between opposite ends of the conduit 18*a* for cooling the conduit via forced air convection in an area predetermined to correspond to the hot spot. The hot spot corresponds to the hottest point along the conduit and may vary from application to application. The fan 26 is spaced from the reflector 24*a* and positioned between opposite ends of the reflector 24*a*. The reflector 24*a* has an aperture 28 for allowing the forced air stream from the fan 26 to pass through the reflector 24*a* to cool the conduit 18*a* at its hot spot. A deflector 34 can be positioned in the airstream for directing portions of the airflow along the entire length of the conduit 18*a*, or to concentrate additional flow on predetermined hot areas.

Figure 3B:
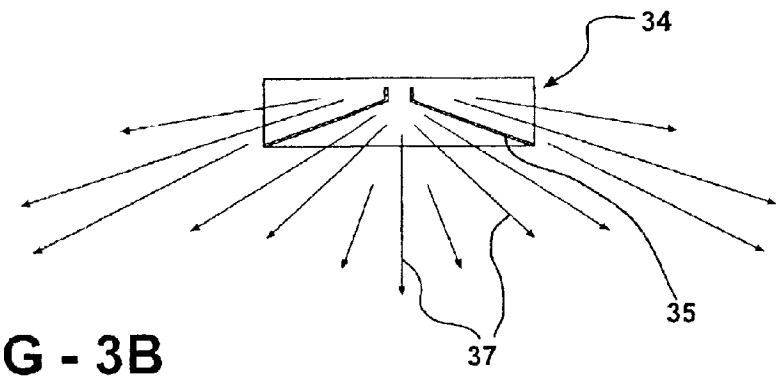
FIG. 3B is a view of a deflector and the associated guide vanes.

The deflector 34 as shown in FIG. 3B, directs the airflow using a plurality of stationary guide vanes 35 for directing the airflow 37 from the fan 26 to one or more predetermined locations on the conduit 18*a*. The fan 26 and more particularly the deflector 34 operate to funnel air along a portion of the length of conduit 18 which permits a more even heating to conduit 18. In the preferred embodiment, the radiant heating system 10*a* operates the fan 26 whenever the thermostat 16*a* signals the gas burner 12*a* to start running. The radiant heating system 10*a* has a temperature sensor 14 for sensing the external surface temperature of the conduit 18*a*. The sensor 14 signals a controller 30 having a temperature limit switch 32 to turn off the gas burner 12*a* when the conduit temperature approaches a predetermined threshold.

Figure 4:
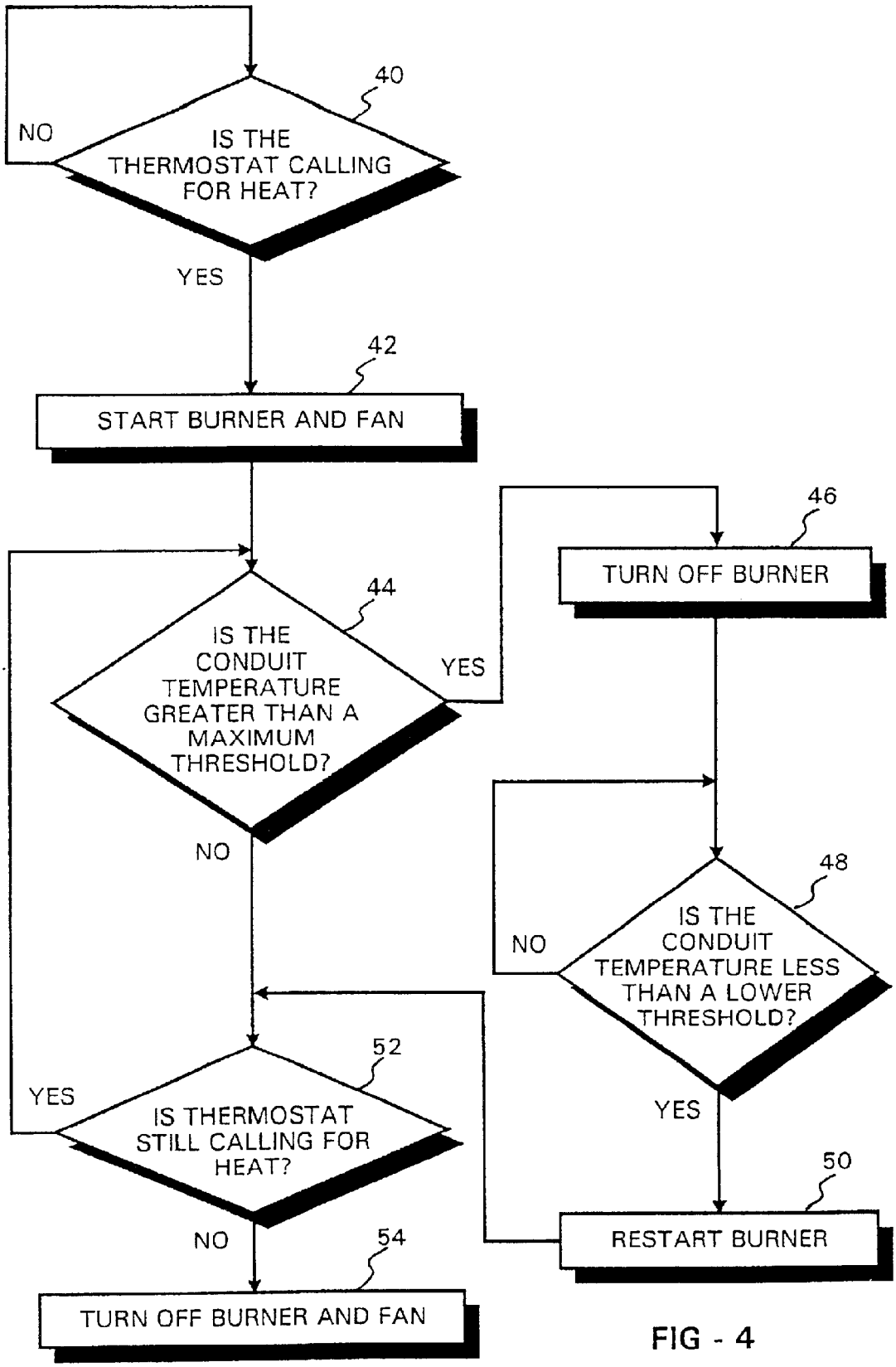
FIG. 4 is a control diagram of the gas burner operating system.

Referring now to FIG. 4, a control schematic illustrates a method for controlling the burner system 10*a*. The control sequence starts by determining if the thermostat is calling for heat in step 40. If heat is not being called for by the thermostat, then the method loops back to the query in step 40. If heat is called for by the thermostat in response to the query in step 40, then the burner starts combusting fuel and the fan is turned on to blow a stream of air across the external surface of the conduit 18*a* at step 42. Next the control system determines whether the conduit temperature is greater than the maximum threshold in query 44. If the temperature is greater than the maximum threshold in query 44, then the power to the burner is turned off at step 46. The controller now determines if the conduit temperature is less than a lower threshold at query 48. If the temperature is higher than the lower threshold, then the controller continues to loop back to query 48 until the temperature falls below the lower threshold. Once the temperature falls below the lower threshold, then the burner is restarted at step 50. The controller then moves back to query 52 to determine whether the thermostat is still calling for heat. If the thermostat is not calling for heat at query 52, then the burner and the fan are turned off at step 54. If the thermostat is still calling for heat at query 52, then the burner and the fan continue to run and the controller loops back to query 44 and continues to determine whether the temperature is greater than the maximum threshold. The controller will continue looping through the algorithm until manually turned off. This control algorithm allows the burner to operate for extended periods of time without overheating the conduit 18*a*.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A radiant heating system comprising a gas burner, a conduit connected to the burner on one end and connected to an exhaust tube at an opposite end for transporting a hot exhaust gas stream, the conduit including a hot spot the hot spot being located remotely from the burner and between opposite ends of the conduit, the radiant heating system comprising:

a fan positioned between opposite ends of the conduit adjacent the hot spot for cooling the external surface of the conduit; and a controller for selectively controlling the gas burner.

2. The radiant heating system of claim 1 further comprising:

a reflector operably associated with the conduit for reflecting infrared rays in a desired direction.

3. The radiant heating system of claim 2, wherein the fan is supported from the reflector and between opposite ends of the reflector.

4. The radiant heating system of claim 2, further comprising:

the reflector having an aperture for allowing forced air from the fan to pass through the aperture in the reflector and cool the conduit.

5. The radiant heating system of claim 2, wherein the reflector is spaced from the conduit for reflecting the infrared rays in a desired direction.

6. The radiant heating system of claim 2 further comprising:

a deflector operably connected to one side of the reflector for directing airflow from the fan to the conduit.

7. The radiant heating system of claim 6, wherein the deflector further comprises a plurality of stationary guide vanes for directing airflow from the fan to a predetermined location on the conduit.

8. The radiant heating system of claim 1 further comprising:

a temperature sensor for measuring the external surface temperature of the conduit and for signaling the controller to shut off the burner when the temperature on an external surface of the conduit approaches a predetermined maximum threshold.

9. The radiant heating system of claim 1 further comprising:

a thermostat for signaling a controller to start and stop the gas burner.

10. The radiant heating system of claim 9, wherein the thermostat signals the controller to start the fan when starting the burner.

11. The radiant heating system of claim 1, wherein the fan is positioned generally between opposite ends of the conduit for cooling the conduit by forced air convection.

12. A method for radiating heat comprising the steps of:

operating a gas burner in response to a temperature sensor and a thermostat;

radiating infrared rays omnidirectionaly from a conduit having two ends, connecting the gas burner with an exhaust manifold, the conduit transferring heat by conduction to an external surface;

reflecting the radiated infrared rays from a reflector in a desired direction; and cooling the conduit with at least one fan located generally between opposite ends of the conduit for cooling the conduit by convection.

13. The method of claim 12 comprising the steps of:

starting a fan with a controller in response to a signal from the thermostat calling for the burner to ignite and produce heat;

blowing air through an aperture in the reflector from the fan to cool the conduit, and directing airflow to a desired location with a deflector connected to one side of the reflector.

14. The method of claim 12 further comprising the step of: shutting the burner off when the temperature sensed by the temperature sensor on the conduit approaches a predetermined maximum threshold.

* * * * *